US005162769A

United States Patent [19]

Dolan et al.

[11] Patent Number: 5,162,769

[45] Date of Patent: Nov. 10, 1992

[54] COAXIAL ELECTROMAGNETIC SWAGE COIL

[75] Inventors: Larry E. Dolan, Renton; Kirk A. Reinkens, Seattle, both of Wash.

[73] Assignee: The Boeing Company, Seattle, Wash.

[21] Appl. No.: 643,601

[22] Filed: Jan. 22, 1991

[51] Int. Cl.[5] ..... H01F 5/00

[52] U.S. Cl. ..... 335/299; 29/419.1

[58] Field of Search ..... 29/419.1, 419.2; 72/56, 72/57, 54; 335/299, 297

[56] References Cited

U.S. PATENT DOCUMENTS

| | | | |
|---|---|---|---|
| 3,258,573 | 6/1966 | Morin et al. | 72/54 X |
| 3,599,461 | 8/1971 | Astl | 29/419.2 X |
| 4,061,007 | 12/1977 | Hansen | 29/419.2 X |
| 4,531,393 | 7/1985 | Weir | 29/419.2 X |
| 4,619,127 | 10/1986 | Sano et al. | 29/419.2 X |
| 4,947,667 | 8/1990 | Gunkel et al. | 29/419.2 X |

FOREIGN PATENT DOCUMENTS

| | | | |
|---|---|---|---|
| 643667 | 6/1962 | Canada | 29/419.2 |

*Primary Examiner*—Leo P. Picard
*Assistant Examiner*—Trinidad Korka
*Attorney, Agent, or Firm*—Conrad O. Gardner; B. A. Donahue

[57] ABSTRACT

An electromagnetic coil configuration used for swaging small tubing. The coil consists of a coaxial arrangement of an inner helical coil and an outer coil shaped as a hollow cylinder with one end open and the other end closed and connected by direct electrical contact to one end of the inner coil.

3 Claims, 1 Drawing Sheet

COAXIAL ELECTROMAGNETIC SWAGE COIL

BACKGROUND OF THE INVENTION

1. Field of the Invention

The present invention relates to the swaging of fittings on lower conductivity tubing and more particularly to swaging of small tubing.

2. Description of Related Art

Present methods include mechanical swaging and standard electromagnetic swaging. In small tubing applications mechanical swaging methods become very hard to implement. The high forces required to swage tend to cause failure of equipment and tooling. Standard electromagnetic swage methods implemented on low conductivity materials require an internal coil and a drive material (copper tubing) which is utilized as a hammer to swage the fitting. Standard coil designs tend to fail where the center conductor turns to wrap around itself. High forces and current levels especially at the corners are the cause of the failure.

In the patent literature, U.S. Pat. No. 3,171,014 issued Feb. 23, 1965 to Ducati teaches that method of forming metal sheet and tubing by electromagnetic technique. Ducati does not address the specific operation and equipment of electromagnetic swaging.

U.S. Pat. No. 3,599,461 issued Aug. 17, 1971 to Aste shows a design for an electromagnetic forming device which utilizes a coil co-designed with other hardware to complete a forming tool not incorporating a likeness to the present swaging coil.

DETAILED DESCRIPTION OF THE INVENTION

Figure 1:
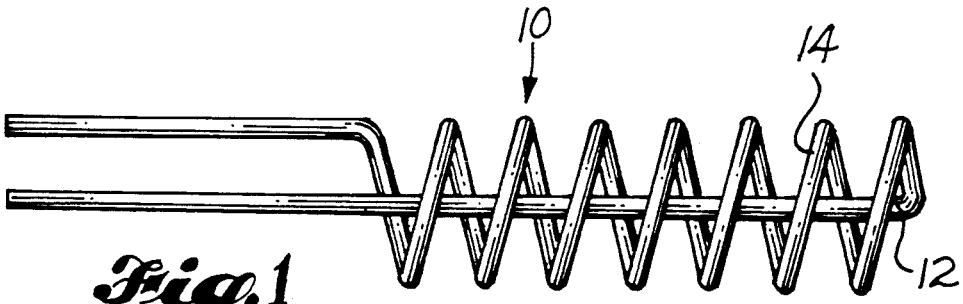
Fig. 1 PRIOR ART
FIG. 1 is a side view of a prior art coil design.
Figure 2:
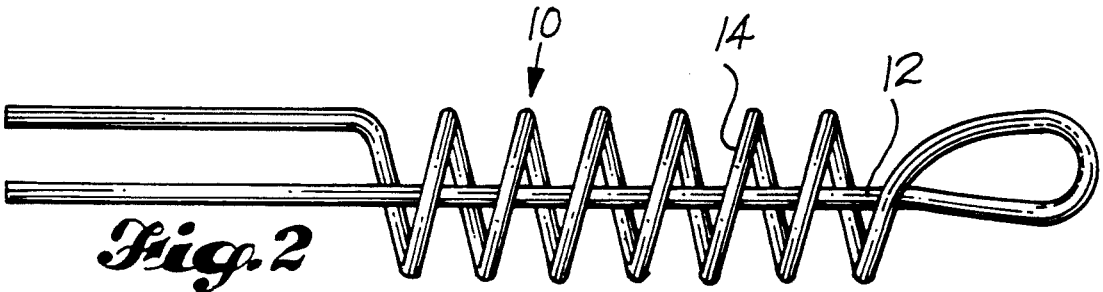
Fig. 2 PRIOR ART
FIG. 2 is a side view of the coil design of FIG. 1 showing the center conductor turning to wrap around itself; and, FIG. 3 is a side view of a preferred embodiment of the present coaxial electromagnetic swage coil.

Turning now to FIG. 1 the prior art coil 10 can be seen to comprise helix winding 10 coaxially disposed about center conductor 12. In FIG. 2, it can be seen how center conductor 12 turns at 16 to wrap around itself. High current forces and current levels especially at the corners are the cause of failure.

Figure 3:
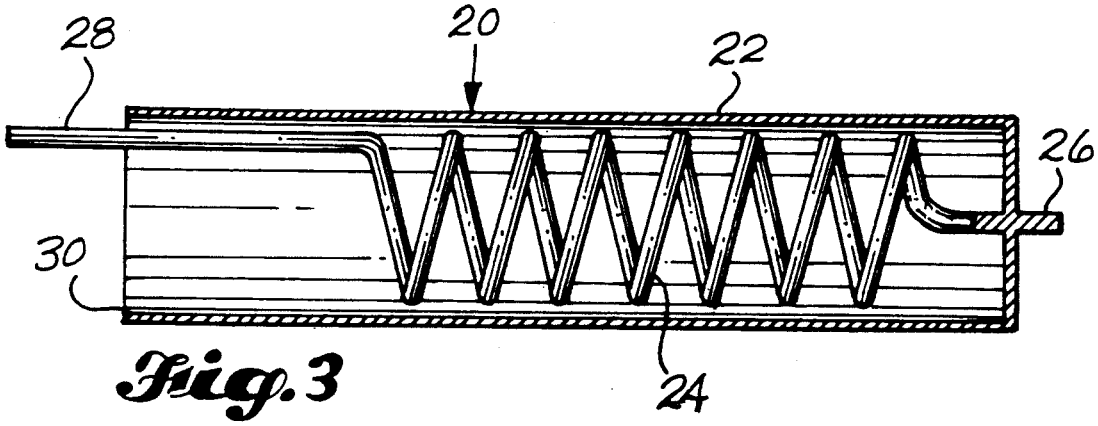

The present preferred embodiment of electromagnetic swage coil 20 shown in FIG. 3 combines coil and drive function into an integral assembly thereby removing the region of coil failure shown in the coil of FIGS. 1 and 2. In electromagnetic swage coil 20, cylindrical shaped copper drive tube 22 which is coaxially disposed about helically shaped coil 24 performs two functions, first it carries the return drive current provided by the power supply to which is coupled at terminal 30 (and to free end 28 of helically shaped coil 24) and second, copper drive tube 22 carries the induced circulating currents produced by helically shaped coil 24 within copper drive tube 22, these circulating currents creating the same pressure as with standard electromagnetic forming where coil and driver are separate. The amount of material available in the return path reduces the current density at the turn around point. The present preferred embodiment coaxial electromagnetic swage coil therefore allows a smaller swage coil to be utilized for application to smaller tubing.

An exemplary coaxial electromagnetic swage coil 20 comprised a 0.44 inch outside diameter copper cylindrically shaped tube 22 which slid into lower conductivity 0.50 inch tubing (e.g. titanium or stainless steel), cylindrically shaped tube 22 being coaxially disposed about a 5 to 7 turn helix 24, made of no. 9 copper wire.

What is claimed is:

1. A combination electromagnetic swage coil and driver for swaging fittings on tubing comprising:

a multiturn helical coil having first and second end portions; and, a cylinder having a closed end and an open end, said cylinder coaxially disposed about said multiturn helical coil, said closed end of said cylinder electrically connected a first end portion of said multiturn helical coil and said second end portion of said open end of said cylinder.

2. An electromagnetic swage coil and driver according to claim 1 wherein said cylinder for swaging fittings on tubing is of higher conductivity than said tubing.

3. An electromagnetic swage coil according to claim 2 wherein said cylinder comprises copper.

* * * * *